United States Patent [19]

Schweigert et al.

[11] Patent Number: 4,509,930

[45] Date of Patent: Apr. 9, 1985

[54] MODULAR STRUCTURES HAVING HINGE AND MATING PIN FASTENING MEANS

[76] Inventors: Lothar L. Schweigert, 3609 Cody Rd., Sherman Oaks, Calif. 91403; Heimo A. Knaus, 1219 Via Sendero, Escondido, Calif. 92025

[21] Appl. No.: 98,268

[22] Filed: Nov. 28, 1979

Related U.S. Application Data

[63] Continuation of Ser. No. 899,524, Apr. 24, 1978, abandoned.

[51] Int. Cl.[3] ..... A63H 33/08

[52] U.S. Cl. ..... 446/109; 52/591; 52/594; 52/DIG. 10; 220/4 F; 404/40; 446/115; 446/116

[58] Field of Search ..... 46/19, 21, 23, 24, 25, 46/26, 30, 31; 404/34, 35, 39, 40, 41; 428/8, 17; 220/4 F; 229/DIG. 1; 52/591, 594, DIG. 1; 446/108–110, 115, 116

[56] References Cited

U.S. PATENT DOCUMENTS

| | | | |
|---|---|---|---|
| 2,061,510 | 11/1936 | Drumpelman | 46/30 |
| 2,366,244 | 1/1945 | Ellerstein | 63/DIG. 3 |
| 3,412,502 | 11/1968 | Riches | 46/25 |
| 3,496,670 | 2/1970 | Sloop et al. | 46/25 |
| 3,676,918 | 7/1972 | Fischer | 46/25 X |
| 3,777,393 | 12/1973 | Baer | 46/25 |
| 3,801,414 | 4/1974 | Chin | 428/17 |
| 3,940,142 | 2/1976 | Hinz et al. | 46/24 X |
| 4,170,082 | 10/1979 | Freedman | 46/29 |

FOREIGN PATENT DOCUMENTS

| | | | |
|---|---|---|---|
| 1298440 | 6/1969 | Fed. Rep. of Germany | 220/4 F |
| 1218924 | 12/1959 | France | 63/DIG. 3 |

*Primary Examiner*—F. Barry Shay
*Attorney, Agent, or Firm*—R. Welton Whann

[57] ABSTRACT

A multilateral modular structure having fastening devices for connection to similar structures, the fastening devices including the module member having surfaces terminating in edges, a tab extending outwardly from an edge of and being offset from said member, the tab being connected to the member by a hinge integral with the member and the tab, the tab having one surface extending outwardly from said edge alignable with one surface of the member, the tab having an opposite surface to its said one surface unaligned with a surface of the member, and a connecting pin adjacent said edge from which the tab extends, the pin extending and supported from said one surface of the member, said opposite surface of said tab being transversely alignable with said pin, said tab having an opening therethrough, said opening having an axis generally parallel to the axis of the pin.

11 Claims, 6 Drawing Figures

MODULAR STRUCTURES HAVING HINGE AND MATING PIN FASTENING MEANS

This is a continuation of application Ser. No. 899,524, filed Apr. 24, 1978, now abandoned.

BACKGROUND OF THE INVENTION

The present invention relates to new fastening means for connecting multilateral modular structures. The modular structures so connected may be toys, containers, lampshades, Christmas decorations, partitions, screens, commercial displays, educational devices, mats, sealings, wall coverings and boxes, for example.

The fastening devices in the present invention include tabs that are integrally hinged to a module and which are adapted to be connected with a mating pin on another module. The tabs are offset from the main body of the module and are in general in transverse alignment with the pins which extend outwardly from one surface of the module in the direction that the tabs are offset.

In the prior art there are integral plastic hinges for connecting various elements together but they do not suggest offset integral hinges and tabs as provided in the present invention for mating with complementary pins on another module. Such prior art is shown in the Baer and Sloope, et al. U.S. Pat. Nos. 3,777,393 and 3,496,670, respectively.

By having the tabs and their hinges offset so that they connect with mating pins on another module, any two sets of tabs and pins are connected so as to be offset both below the main plane of the modules and from the joined edges of the modules, the tabs extending in opposing directions so that the connection of the flexible and resilient material provides a spring loaded engagement.

SUMMARY OF THE INVENTION

The present invention may be made from suitable plastic materials employing injection molding techniques. The plastics usable are generally flexible and resilient but when secured together in accordance with the present invention provide a relatively rigid structure. A substantially rigid connection is made having at least one tab extending outwardly from a generally planar module and offset from the main plane thereof and by having the tab of the module mating with a pin on another, and also by having an opposing tab on the other, mating with a pin of the first module.

Accordingly it is an object of the invention to provide a fastening device including integrally hinged tabs extending from the modules, the tabs having openings therein for engagement with pins extending from a surface of respective adjacent modules, the pins being in transverse alignment with the plane of the tabs and being in axial alignment with the openings in complementary tabs on the modules.

It is another object of the invention to provide an improved fastening means, as described in the preceding paragraph, whereby the modules are easily assembled together by snap-fit and similarly easily disassembled by snapping the tabs off of the respective pins.

It is still another object of the invention to provide a fastening means, as described in the preceding paragraphs, in which the tabs are integrally connected to the modules by a flexible strong hinge.

It is a further object of the invention to provide a fastening device, as described in the preceding paragraphs, to which the pins and tabs are joined offset from the edges of the modules and are connected in opposing directions to provide a spring loaded positive engagement.

It is a still further object of the invention to provide multilateral modules and fastening means therefor molded in one piece in simple designs, easy to store.

It is another object of the invention to provide modules and connecting devices therefor, as described in the preceding paragraphs, in which unusual corner strength in the connections is developed by having the tabs overlapping adjacent modules and connected to the pins extending therefrom.

It is still another object of the invention to provide fastening devices, as described in the preceding paragraphs, which are all identical.

It is a further object of the invention to provide fastening tabs, as described in the preceding paragraphs, which pivot on hinges integral with the modules through an arc of about 300°. This permits the fastening tabs on the modules to provide structures that are flat, square, and having angular joints, both acute and obtuse.

It is still a further object of the invention to provide connected modules, as described in the preceding paragraphs, in which accidental disassemblies are made very difficult by two or more tab and pin attaching devices. One tab extends from one module and another tab extends from the adjacently connected module, and connecting tabs are disposed in opposite directions and are positioned in an offset relationship to the center line of the hinges, which are at the edges of the adjacent connected modules.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENTS

Figure 1:
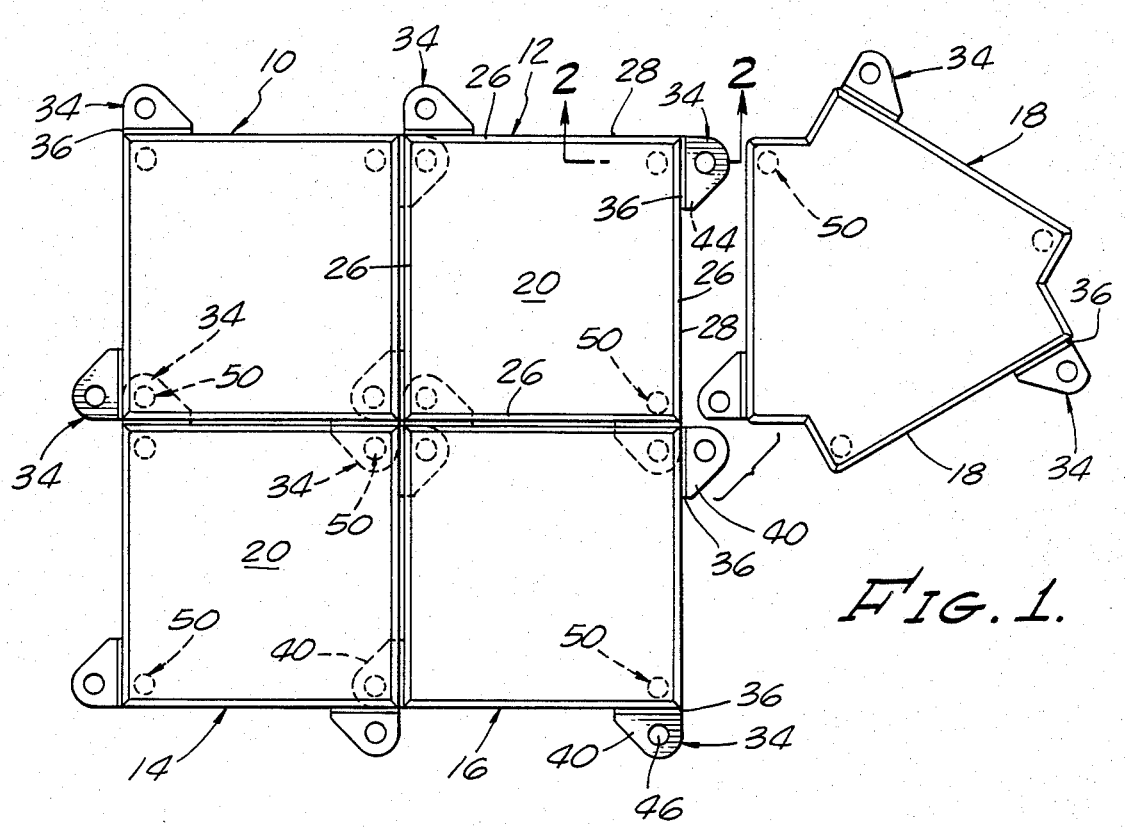
FIG. 1 is a plan view, partially exploded, in which a plurality of modules are connected together by fastening means according to the invention and in which one module is separated therefrom, illustrating the means for fastening to an adjacent module.
Figure 5:
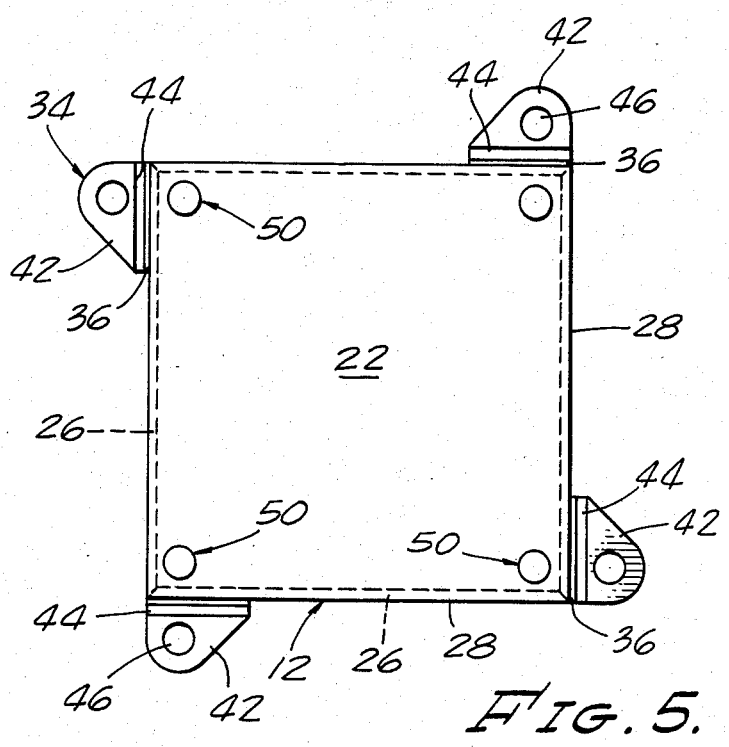
FIG. 5 is an enlarged detailed reverse plan view of one of the rectangular modules shown in FIG. 1.

Referring again to the drawings, there is shown in FIG. 1 four generally planar, rectangular modules 10,12, 14 and 16, secured together and a fifth module 18 of irregular shape in position to be secured to the module 12. In FIG. 5 there is shown a reverse plan view of one of the four connected modules or members, such as 12, for example. Each of the rectangular modules has an upper or first plane member surface 20 and a lower or second generally plane member surface 22. The surfaces and configurations of the modules can be substantially varied but are shown rectangular and planar for simplicity.

Referring to the module or member 12 for details, it being identical to the other three rectangular modules, its upper surface 20 has four beveled or tapering member edges 26. The member edges 26 terminate at the end of the taper in a narrow, vertical outermost edge 28, best seen in FIG. 3.

Figure 2:
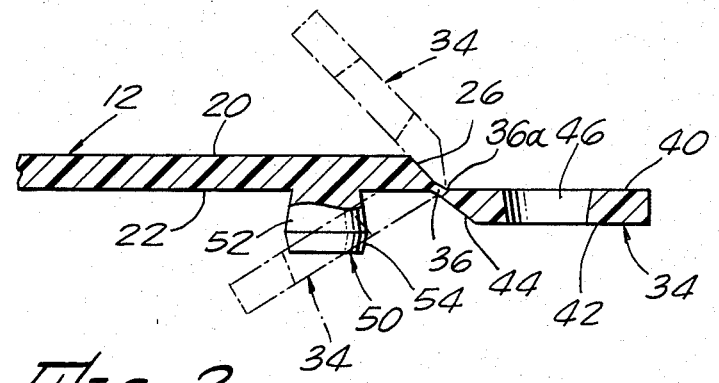
FIG. 2 is a fragmentary cross-sectional view illustrating the module and its integral hinge connection to a tab, and the module having a pin adjacent the tab and the module edge, taken substantially along the lines 2—2 of FIG. 1.
Figure 3:
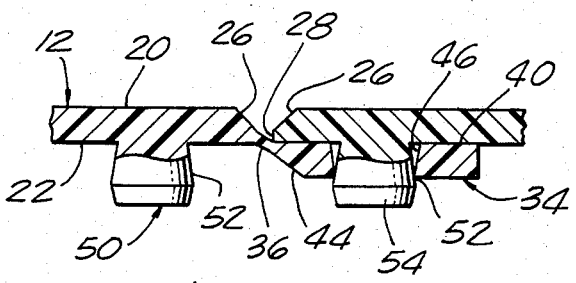
FIG. 3 is a cross-sectional side view illustrating the connection of two modules by means of a pin on one mated with a tab on the adjacent module.

Each of the rectangular modules has a tab fastener 34 extending outwardly of each of the four edges. The fasteners are all of the same shape and are connected at the vertical or outermost edge 28 by means of a hinge 36, substantially rectangular in the end view as shown in FIG. 2. The hinge or hinge means is the type of hinge which permits the tab to swing around a pivot or axis in order that the adjacent end of the tab is always held close to the edge of the member to which the tab is hingedly connected. As shown in FIGS. 2 and 3, an upper or first tab surface 40 of the tab 34 extends outwardly from the hinge 36 and is alignable with the undersurface 22 of the module 20, for example. A lower or second tab surface 42 of each tab is not alignable with surfaces such as 20 and 22 of the modules so that the tabs are all downwardly offset from the main body of the modules, Each tab has at the inner end of the surface 42 a tapering or bevel surface 44 which terminates inwardly at the hinge 36. It will be noted that the hinge 36 hingeably joins the members and the tabs at the corners 36*a*. Each tab 34 has a conical opening 46 therethrough, having its larger diameter at the surface.

Figure 4:
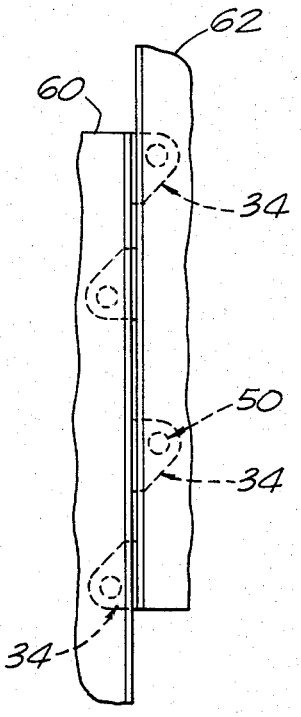
FIG. 4 is a fragmentary plan view illustrating a series of fastening tabs and pins connecting two modules having adjacent straight edges.

In all multilateral modules, examples of which are shown in FIG. 1, modules 12 and 18 and in FIG. 4 for illustrative purposes, a pin 50 extending from the lower surface 22 of the module, is positioned adjacent a rectilinear edge 28 from which a tab 34 extends and is spaced from the tab along the edge so that for each tab along an edge, there is a corresponding pin laterally offset from the tab across the center line of the integral hinge 36. (See FIG. 4).

The spacing of the respective tabs and pins along rectiliner edges is such that the pin and tab on the edge of one module mate with the respective tab and pin on another module.

This offset tab-pin spacing along a given edge of a module produces a variety of tab-pin configurations depending on the geometric shape of the module, as in FIG. 1, modules 12 and 18.

In the rectangular modules shown each tab 34 has a connecting pin 50 inwardly thereof and transversely aligned therewith, the pin extending from the supporting surface 22 which is in alignment with the surface 40 of the tab. The axes of the openings 46 in the tabs are parallel to the axes of the pins 50 and the hinges 36 are equally spaced from the axes of respective pins and openings, FIG. 3. Extending downwardly from the surface 22 there is a diverging conical frustum 52 forming the upper part of the pin and extending therefrom is a converging conical frustum portion 54, the pin terminating at its lower end.

As may be seen in FIGS. 1 and 5, each edge of the rectangular modules has one tab extending therefrom at one end of the edge and inwardly thereof is a pin whose axis is on a line extending through the axis of the opening in the respective tab, the line being perpendicular to the edge of the module and to the pivot line of the hinge. Each pin adjacent a tab is adapted to be inserted into a tab on a complementary module to be connected thereto, 10 and 14, for example. The pins snap into the tab openings and the narrow diameter of the openings snugly fit on a diverging part of the frustum 52, FIG. 3. The pins and openings are in a snap-fit bit relationship.

The connection arrangement can be best seen in FIG. 1 where the module 18 is adapted to be secured to the module 12. Here, as with the other modules, the upper tab 34 in the drawing is placed under the bottom surface of the module 18 to have the opening therein snap-fit over the pin extending from the lower surface of the module at the upper end. The lower tab 34 similarly will extend under the surface 20 on the surface 22 and onto the pin at the lower right hand corner in the module 12. This arrangement of attachment is a positive connection in that both tabs are offset from the center lines of the hinges and extend in opposite directions to provide a spring loaded engagement between the two modules. Having the two tabs extending in opposite directions also substantially prevents accidental disassemblies or unwanted disconnections.

In comparing the connections between the module 12 to the module 18 and the module 12 to the module 16, it should be noted that the irregular module 18 does not have a pin inwardly adjacent its lower tab. The rectangular modules, being adapted to be connected on all sides to another module, have two pins adjacent each edge having their axes on a line parallel to the edge and to the connecting hinges on the opposing flaps. The connection shown in FIG. 3 illustrates the connection to be made at the top of the modules 12 and 18 leaving the pin adjacent the tab unconnected but being adapted to be connectable to another module at the upper end of the module 12.

It should be noted that in a plastic material used the modules along the edges 26 and 28 may be slightly or very flexible. However when two modules are joined, as 10 and 12, for example, the fastening means of the tabs and pins at both ends of the respective edges provide a relatively rigid structure. It should also be noted that in the connections between two modules the tabs and pins are laterally offset on opposite sides of the center lines of the respective two hinges.

In FIG. 4 the two modules of 60 and 62 are shown to be connected by a series of tabs 34 and pins 50 in the same manner as the tab and pins connect the rectangular modules in FIG. 1. In all cases the respective parts of the connecting edges, the tabs, and the pins are identical as described in relation to FIGS. 1–3 and 5. In the situation in FIG. 4, the use of additional fastening devices is illustrated to show how they may be used and that they would obviously provide additional holding strength and rigidity along the opposing edges of the connected modules.

Figure 6:
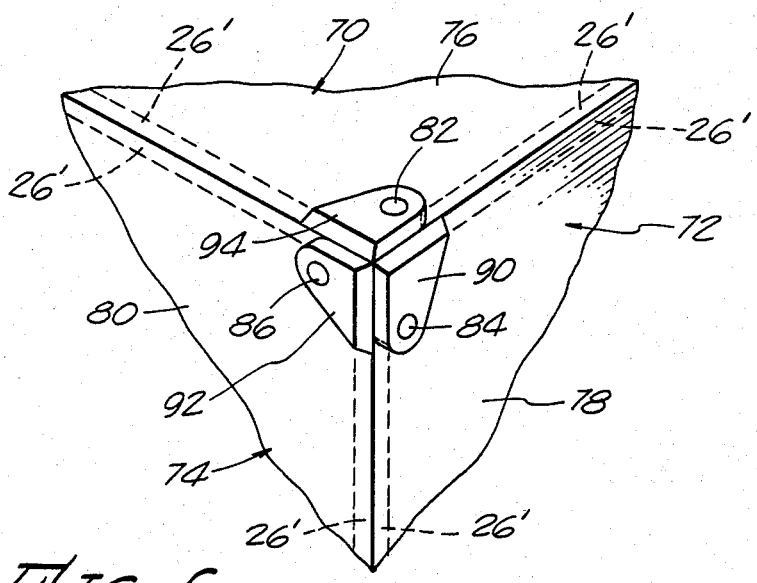
FIG. 6 is a fragmentary view of a three dimentional figure made according to the invention

In FIG. 2 the tabs 34 as shown in phantom outline above and below the hinge, may be pivoted on the hinge through an arc of approximately 300°. This permits wide angle variations in attachment in the joints, both acute and obtuse. For example as shown in FIG. 6 there are three modules 70, 72 and 74 connected to form a right angle box corner which may be a part of a cube or some other three dimensional structure. The modules here have beveled or tapered surfaces 26', equivalent to the same surfaces in FIG. 2, extending inwardly and not visible from the exterior. The module 70 has a surface 76, the module 72 has a surface 78 and the module 74 has a surface 80 all equivalent to surface 22 in FIG. 2. From these surfaces on the modules 70, 72, and 74, connecting pins 82, 84, and 86, respectively extend, all in the same relative positions as the pins 50 in FIG. 2. Similarly the module 70 has a tab 90, the module 72 has a tab 92 and the module 80 has a tab 94, all equivalent to the tabs 34. Pivoted at right angles on their hinges, they are in a position equivalent to that which would exist in FIG. 2 if the tab 34 were pivoted 90° upwardly on its hinge and away from the adjacent pin. Thus the tab 90 has been pivoted 90° on its hinge away from pin 82 to engage the pin 84, the tab 92 has been pivoted 90° on its hinge away from the pin 84 to engage the pin 86, and the tab 94 has been pivoted 90° away from pin 86 to engage the pin 82. To complete a cube from the structure shown in FIG. 6, the pins and tabs, shown in FIGS. 1 and 3, at the other ends of the edges of the modules in contact in FIG. 6 would be similarly bent but in the opposite direction from the adjacent respective pins. That is, there would be a tab at the other end of the module 72 that would be bent upwardly to engage another pin on the module 70 and the tab at the end of the module 70 on the edge, not shown would be bent downwardly to engage a pin on another module.

The invention and its attendant advantages will be understood from the foregoing description and it will be apparent that changes may be made in the form, construction and arrangement of the parts of the invention without departing from the spirit and scope thereof or sacrificing any of its material advantages, the arrangements hereinbefore described being merely by way of example. We do not wish to be restricted to the specific forms shown or uses mentioned except as defined in the accompanying claims, wherein various portions have been separated for clarity of reading and not for emphasis.

We claim:

1. A fastening device for releasably connecting one member to another, the combination including:

a. a member having surfaces terminating in a member edge, b. a tab extending outwardly from but not overlapping said member edge, said tab having a tab edge positioned adjacent to said member edge, said tab being offset from the plane of said member and having an opening therethrough, c. hinge means positioned where said member edge and said tab edge are adjacent to each other for hinging together said member and said tab, said hinge means permitting said tab to swing from planar alignment of said tab with said member, into various angular positions, d. a pin extending and supported from the surface of said member, said pin being positioned inwardly from said member edge so that said pin is offset along said member edge from which said tab extends, and e. said pin and said tab being adapted to be connected to respective tab and pin means similarly arranged on another member in order to secure said members together.

2. The combination as defined in claim 1 in which said tab is offset from said members so that one surface of said member and one surface of said tab are in substantial alignment with each other when said member and said tab are lying in parallel planes.

3. A combination as defined in claim 2 in which the member edge of said member and said tab is slanted from the hinge means to permit free hinge movement of said tab relative to said member in at least one direction.

4. A combination as defined in claim 3 in which the edges of said member and said tab are tapered so to permit said tab to be swung relative to said member in two directions.

5. A combination as defined in claim 4 in which said member edge forms a member corner on said member, and said tab edge forms a tab corner on said tab, and in which said tab and said member are so positioned that the corners meet, and in which said hinge means is formed adjacent the location where said corners meet.

6. A combination as defined in claim 5 in which said member edge slants from said member corner toward said member, and in which said tab edge slants from said tab corner towards said tab, whereby said tab is enabled to swing from a position in a plane parallel to said member into angular positions on either side of said plane.

7. A fastening device for releasably connecting two members together, the combination including:

a. a member having a first and second surface terminating in an edge providing a member corner, b. at least one non-overlapping tab extending outwardly from the edge of said member, said tab having first and second surfaces terminating in a tab edge which provides a tab corner, said member and said tab being positioned adjacent to each other with said corners being positioned adjacent to each other, and with said tab and said member being offset from each other, c. integral hinge means positioned at said corners for connecting said member and said tab and permitting said tab to swing into different angular positions, d. at least one pin extending and supported from said first surface of said member, said pin being adjacent to said member edge and disposed inwardly of said member edge from said tab so that said pin is offset along said member edge from which said tab extends, and e. said pin and said tab on said member being adapted to be removably connected to a respective tab and pin of another member whereby a plurality of members are connected together.

8. A fastening device for releasably connecting one member to another, the combination:

a. a plurality of members, each having a first member surface and a second member surface and a member edge to which said surfaces join, said member edge slanting inwardly from said first member surface toward said second member surface, b. at least one tab extending outwardly from but not overlapping said member edge of each of said members in a plane generally parallel to the plane of the member, each tab having a first tab surface and a second tab surface and a hole in said tab extending between said tab surfaces, said first tab surface being aligned with said second member surface, and including a tab edge extending from an end of said first tab surface to an end of said second tab surface, c. hinge means joining each tab to a member, said hinge means being positioned where said second member surface and said first tab surface are substantially aligned with each other, said hinge means permitting each tab to swing from planar alignment with the member to which it is connected by said hinge means, into various angular positions, and d. a pin extending outwardly from the second surface of each member at substantially right angles and positioned inwardly from the member edge of said member, said pins extending through said holes in said members to hingedly connect said members with their slanting member edges adjacent to each other in order to hingingly connect said members together.

9. A connector for use in a construction embodying a plurality of such connectors, said connectors comprising:

a substantially planar base plate having a peripheral polygonal edge defining a plurality of adjoining sides;

a single attachment member hingedly mounted to and extending laterally outwardly of certain of said sides, adjacent the corresponding end of each of said certain sides, said attachment member comprising a substantially planar tab having an aperture therein;

connecting means formed on said base plate adjacent the opposite ends of said certain sides, for releasably engaging corresponding attachment members on adjacent ones of said connectors, said connecting means comprising upstanding pins formed on at least one face of said plate in registry with the apertures in said corresponding tabs on adjacent connectors, for insertion into said apertures in releasable frictional engagement therewith.

10. The connector defined by claim 9, wherein said tabs include a flexible resilient transverse hinge portion of reduced thickness, formed integrally with the edge of said base plate, for rotation of said tabs through an arc in excess of 180° relative to the plane of said base plate.

11. The connector defined by claim 10 wherein said tabs are formed to be normally in alignment with said one face of said base plate, whereby the corresponding faces of the base plates of adjacent connectors are substantially co-planar when said tabs and pins are in engagement.

* * * * *